US006240727B1

(12) United States Patent
Goldstein et al.

(10) Patent No.: US 6,240,727 B1
(45) Date of Patent: Jun. 5, 2001

(54) MANUFACTURE OF NITINOL RINGS FOR THERMALLY RESPONSIVE CONTROL OF CASING LATCH

(75) Inventors: David Goldstein, Potomac, MD (US); Peter Hall, Columbus, OH (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/559,053

(22) Filed: Apr. 27, 2000

(51) Int. Cl.[7] ..... F01B 29/10
(52) U.S. Cl. ..... 60/528; 60/527; 415/134
(58) Field of Search ..... 60/527, 528; 415/134, 415/136, 138, 12

(56) References Cited

U.S. PATENT DOCUMENTS

| | | | |
|---|---|---|---|
| 4,282,033 | 8/1981 | Goldstein et al. . | |
| 4,283,233 | 8/1981 | Goldstein et al. . | |
| 4,304,613 | 12/1981 | Wang et al. . | |
| 4,373,859 * | 2/1983 | Thebert | 415/134 X |
| 4,722,825 | 2/1988 | Goldstein . | |
| 4,787,817 * | 11/1988 | LaGrange et al. | 415/138 X |
| 4,938,026 | 7/1990 | Goldstein . | |
| 4,996,842 | 3/1991 | Goldstein . | |
| 5,003,779 | 4/1991 | Goldstein . | |
| 5,035,572 * | 7/1991 | Popp | 415/12 |
| 5,145,506 | 9/1992 | Goldstein et al. . | |
| 5,156,806 | 10/1992 | Sutula et al. . | |
| 5,408,932 | 4/1995 | Hesse et al. . | |
| 5,482,574 | 1/1996 | Goldstein . | |
| 5,685,456 | 11/1997 | Goldstein . | |
| 5,700,129 * | 12/1997 | Kocian | 415/136 X |
| 6,041,728 | 3/2000 | Goldstein et al. . | |

* cited by examiner

*Primary Examiner*—Hoang Nguyen
(74) *Attorney, Agent, or Firm*—John Forrest; Jacob Shuster

(57) ABSTRACT

Axial sections of a casing assembly such as that of a rocket are maintained interconnected by latching prongs on which thermally responsive Nitinol rings are positioned. Operational control over the latching prongs is achieved by selection of material properties and dimensions of the Nitinol rings during manufacture thereof.

12 Claims, 2 Drawing Sheets

FIG. 1
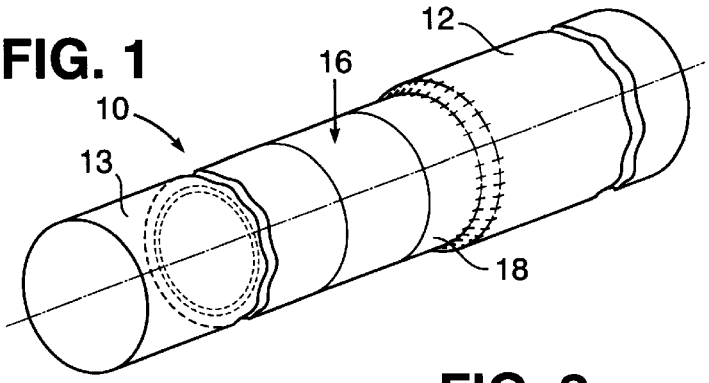
FIG. 2
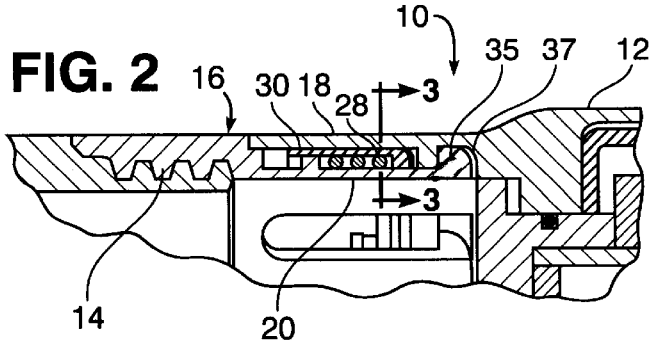
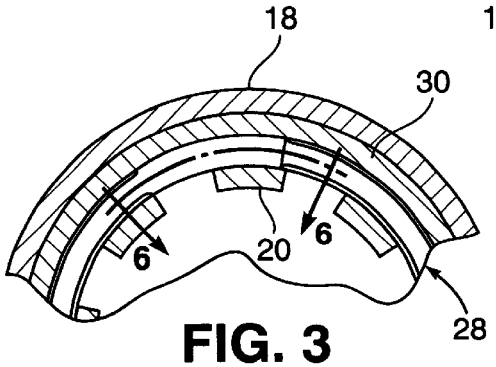
FIG. 3
FIG. 4
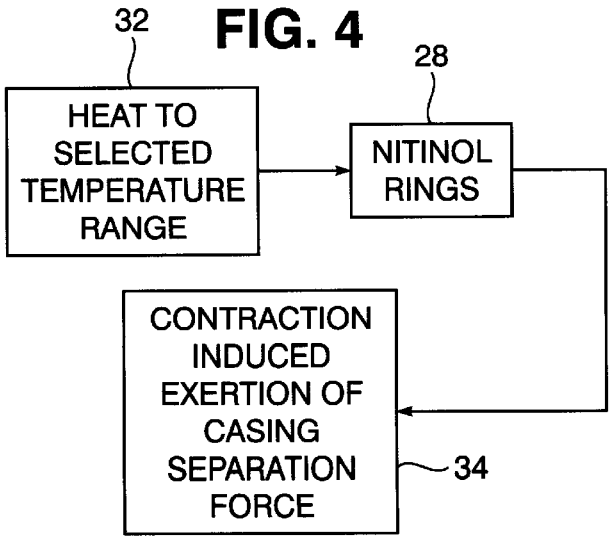

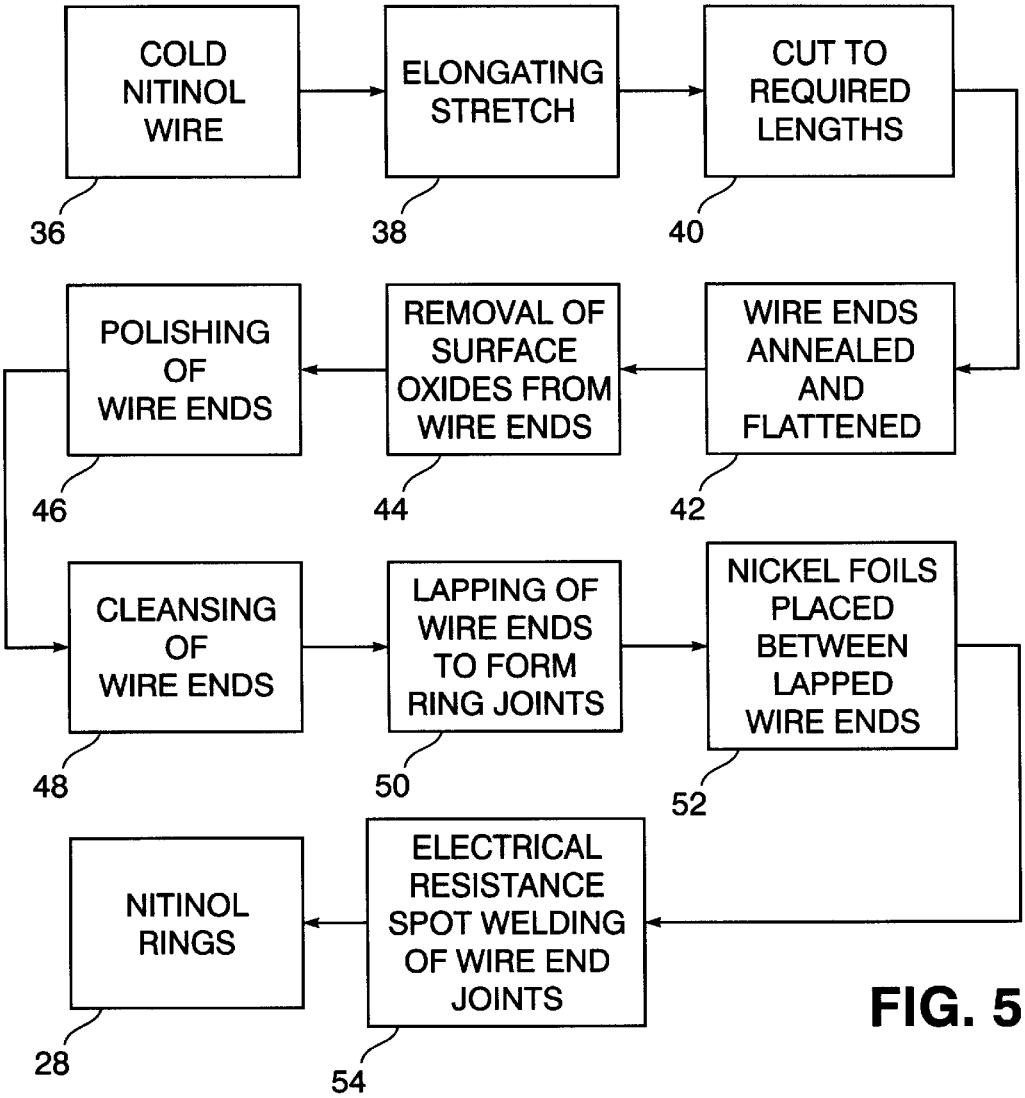
FIG. 5
FIG. 6
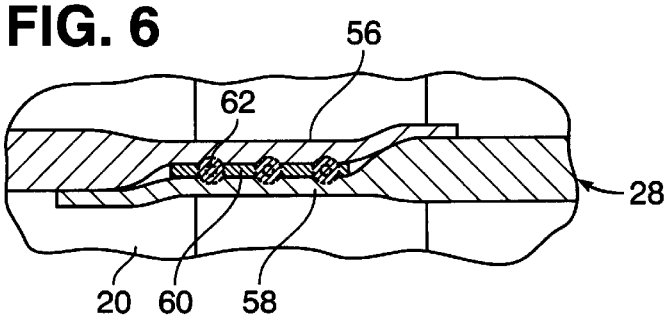

MANUFACTURE OF NITINOL RINGS FOR THERMALLY RESPONSIVE CONTROL OF CASING LATCH

The present invention relates in general to the formation of thermally responsive control means for releasable latches interconnecting sections of a casing.

BACKGROUND OF THE INVENTION

Ring-like elements made of shape memory material such as Nitinol have been commercially used for retention of connector pins under ambient temperatures. Such Nitinol rings have also been experimentally used to release latch pins at elevated temperatures within tubular casings as disclosed for example in U.S. patent application Ser. No. 09/107,314 filed Jun. 30, 1998, the disclosure of which is incorporated herein by reference. It is therefore an important object of the present invention to provide a method of manufacturing such Nitinol rings so as to meet the installational and operational requirements of thermally responsive control of latching means used to maintain sections of casings interconnected.

SUMMARY OF THE INVENTION

In accordance with the present invention, a wire made of Nitinol material having suitable properties is cut into required lengths corresponding to bent shapes such as the circumferential lengths of rings to be radially positioned between nested portions of a releasable latching arrangement interconnecting sections of a casing such as that of a rocket. The cut sections of the Nitinol wire are bent into their ring shapes after the opposite end portions thereof are annealed and flattened for overlapping thereof and then undergo welding to form joints. Welding of the ring joints is performed by use of an electrical resistance technique with either thin nickel foil sheets disposed between the overlapped wire end portions of the rings or plating/coating thereof with nickel to cause diffusion of melted nickel into the wire end portions at spot weld locations according to one embodiment. Cracking of the rings otherwise induced by the heat generated during the welding processes is thereby minimized and/or avoided.

BRIEF DESCRIPTION OF DRAWING

A more complete appreciation of the invention and many of its attendant advantages will be readily appreciated as the same becomes better understood by reference to the following detailed description when considered in connection with the accompanying drawing wherein:

FIG. 1 is a perspective view of a tubular rocket casing assembly as one example of an installational environment with which the present invention is associated;

FIG. 2 is a partial section through the tubular rocket casing assembly shown in FIG. 1, illustrating installation of Nitinol rings therein;

FIG. 3 is a partial section view taken substantially through a plane indicated by section line 3—3 in FIG. 2;

FIG. 4 is a block diagram illustrating the thermally responsive control exercised by the Nitinol rings;

FIG. 5 is a block diagram illustrating the method used for manufacture of the Nitinol rings; and FIG. 6 is a partial section view taken substantially through a plane indicated by section line 6—6 in FIG. 3.

DETAILED DESCRIPTION OF THE PREFERRED EMBODIMENTS

Referring now to the drawing in detail, FIGS. 1 and 2 illustrate as one example of an installation associated with the present invention, a rocket casing 10 such as that disclosed in U.S. patent application Ser. No. 09/107,314 aforementioned. The casing 10 includes a main tubular aft section 12 constituting a rocket motor and a forward warhead section 13. Such casing sections 12 and 13 as shown in FIG. 2 are interconnected through a cylindrical adapter component 16 which has internal threads 14 adjacent one axial end thereof in threaded engagement with the forward section 13. Also, a plurality of circumferentially spaced prong formations 20 of the adapter component 16 project toward its other axial end in radially spaced underlying relation to a radially outer axial end component 18 of the aft casing section 12. The forward and aft sections 13 and 12 of the casing 10 when axially assembled as shown in FIG. 2 are held interconnected under control of three Nitinol rings 28 positioned in close axially spaced relation to each other, radially between the prong formations 20 and the outer axial end component 18 of the casing section 12. Also, a polyethylene shield 30 is disposed in protective overlying relation to the three Nitinol rings 28 as shown in FIGS. 2 and 3. The properties and dimensions of the Nitinol rings 28 are selectively adjusted during manufacture thereof in accordance with the present invention to meet various requirements for separation of the casing sections 12 and 13, otherwise held interconnected by the Nitinol rings 28 through the adapter component 16 in the installational arrangement as hereinbefore described.

As diagrammed in FIG. 4, the Nitinol rings 28 undergo heating 32 to a selected temperature range causing contraction 34 of such rings to thereby induce a separation force to be exerted by the rings on the prongs 20, in a radially inward direction in the installation shown in FIG. 2, sufficient to displace latch projections 35 on the ends of the prongs 20 out of a groove 37 formed in the axial end component 18 of the casing section 12. The sections 12 and 13 of the casing 10 are thereby unlatched and separated. In the case of a rocket motor casing assembly, such separation of the nested casing section 12 and adapter component 16 was caused to occur before propellant ignition as a result of a 4% contraction in circumferential length of the Nitinol rings 28 because of heating to a temperature range between 210° F. and 240° F.

The dimensional and operational requirements for the Nitinol rings 28 were achieved by manufacture thereof from a cold Titanium-rich alloy wire 36 of 0.028 inch diameter as diagrammed in FIG. 5. Such wire 36 was elongated approximately 6% in length by stretch 38 and then cut into sections 40 of required lengths dimensionally corresponding to the circumferential lengths of the rings 28 plus the overlapping distance. The end portions of such cut lengths of wire were then annealed and flattened as denoted by 42 in FIG. 5. The flattened wire ends then underwent removal of surface oxides by 800 grit SiC paper and cleansed with acetone and methanol as denoted by 48. The flattened and cleansed end portions of each cut length of wire were then overlapped to form ring joints by bending of each cut length of wire into the circular ring shape as denoted by 50 in FIG. 5. Nickel foils 52 were then placed between the overlapped end portions of the wire while positioned on a holding fixture for welding of the joints so formed by use of an electrical resistance technique 54, to thereby complete formation of the rings 28.

FIG. 6 shows the welded joint of each ring 28 formed by the aforesaid welding of the flattened overlapped end portions 56 and 58 thereof. Such welding involves placement of a consumable nickel foil 60 between the flattened, overlapped portions 56 and 58 of the wire ends causing melting of such foil at spaced locations of resistance spot welding causing the heating and diffusion of melted foil portions 62 into the wire end portions 56 and 58. The resistance spot welding technique includes the maintenance of forging pressures on opposing electrodes through which electrical resistance heating and cooling occurs at each weld spot location, until the welding process thereat is completed. Use of such electrical resistance welding minimized solidification cracking of the wire which otherwise occurs because of heating during the welding process for high titanium content Nitinol. Secondary cracking was also avoided by the aforesaid spot welding involving placement of nickel foils 60, of 0.001 inch thickness or less, between the overlapping end portions 56 and 58 of each ring 28 followed by the spot welding processes as hereinbefore described.

Obviously, other modifications and variation of the present invention may be possible in light of the foregoing teachings. It is therefore to be understood that within the scope of the appended claims the invention may be practiced otherwise than as specifically described.

What is claimed is:

1. In combination with a casing having axial sections interconnected by latch means and thermally responsive means for inducing separation of the casing sections by release of the latch means, a method of manufacturing the thermally responsive means from wire made of shape memory material having properties and dimensions adapted to accommodate positioning thereof on the latch means and said release of the latch means, comprising the steps of: elongating said wire to a selected extent; cutting the elongated wire into sections of required length; flattening end portions of said sections of the wire; bending each of said sections of the wire into shape to overlap the flattened end portions thereof; and welding the overlapped end portions to each other to complete formation of the thermally responsive means.

2. The combination as defined in claim 1, wherein the shape memory material is Nitinol.

3. The combination as defined in claim 2, wherein said latch means comprises: a plurality of circumferentially spaced prongs projecting from one of the casing sections into radially spaced underlying relation to the other of the casing sections having a groove within which latch projections on the prongs are received.

4. The method as defined in claim 3, wherein said welding employs electrical resistance heating.

5. The method as defined in claim 4, including the step of: placing nickel foil between the overlapped end portions of the shaped wire sections before said welding to minimize cracking of the wire sections by said heating during the welding.

6. The method as defined in claim 5, wherein said end portions of the wire sections are annealed before said flattening thereof.

7. The method as defined in claim 1, wherein said end portions of the wire sections are annealed before said flattening thereof.

8. The method as defined in claim 7, including the step of: placing metal foil, plating or coating between the ring shaped wire sections before said welding.

9. The combination as defined in claim 1, wherein said latch means comprises: a plurality of circumferentially spaced prongs projecting from one of the casing sections into radially spaced underlying relation to the other of the casing sections having a groove within which latch projections on the prongs are received.

10. In combination with a casing having axial sections; latch means for interconnecting said casing sections; and thermally responsive means on the latch means for release thereof; said thermally responsive means having properties and dimensions selected to accommodate positioning thereof on the latch means and said release of the the casing sections by the latch means.

11. The combination as defined in claim 10, wherein said thermally responsive means comprises a plurality of Nitinol rings.

12. The combination as defined in claim 10, wherein said thermally responsive means undergoes contraction to effect said release of the latch means.

* * * * *